US010926186B2

(12) United States Patent
Smith et al.

(10) Patent No.: US 10,926,186 B2
(45) Date of Patent: Feb. 23, 2021

(54) LIGHTED TOY FIGURINES AND RELATED SYSTEMS AND METHODS

(71) Applicant: CHARM GENIUS LIMITED, Shatin (HK)

(72) Inventors: Ross R. Smith, Sarasota, FL (US); Mark Andrew Starling, Sarasota, FL (US)

(73) Assignee: Charm Genius Limited, Shatin (HK)

( * ) Notice: Subject to any disclaimer, the term of this patent is extended or adjusted under 35 U.S.C. 154(b) by 0 days.

(21) Appl. No.: 16/054,404

(22) Filed: Aug. 3, 2018

(65) Prior Publication Data

US 2019/0038987 A1 Feb. 7, 2019

Related U.S. Application Data

(60) Provisional application No. 62/540,671, filed on Aug. 3, 2017.

(51) Int. Cl.
*A63H 3/16* (2006.01)
*A63H 33/04* (2006.01)
(Continued)

(52) U.S. Cl.
CPC ..... *A63H 33/042* (2013.01); *A63H 3/006* (2013.01); *A63H 33/08* (2013.01); *A63H 33/086* (2013.01); *A63H 33/26* (2013.01)

(58) Field of Classification Search
CPC ..... A63H 33/042; A63H 33/08; A63H 33/26; A63H 33/086; A63H 3/006
(Continued)

(56) References Cited

U.S. PATENT DOCUMENTS 2,135,289 A * 11/1938 Levy ..... A63H 3/46 446/391
2,473,394 A * 6/1949 Scott ..... A42B 3/0433 340/321
(Continued)

OTHER PUBLICATIONS brickowl.com, Brick Owl LEGO Minifig Helmets, available on Mar. 16, 2016, retrieved on Sep. 17, 2018, https://web.archive.org/web/20160316231746, http://www.brickowl.com:80/catalog/lego-parts/minifig/headgear/helmet.
(Continued)

*Primary Examiner* — Vishu K Mendiratta
(74) *Attorney, Agent, or Firm* — LaMorte & Associates, P.C.

(57) ABSTRACT

A lighted toy figurine comprises a figurine body assembly and a headgear assembly. The figurine body assembly includes a head and a body section. The headgear assembly includes a headpiece and a pack element extending downwardly therefrom along a side of the body section. The pack element includes a power source and light powered thereby. The headpiece defines an internal channel communicating between a headpiece opening and the light such that illumination from the light is visible through the headpiece opening via the internal channel. An inductive power transfer system for an interlocking building block set comprises a toy building block and an inductive transmission assembly. The toy building block includes an electrical load and a power source, the power source including an inductive receiver coil. The inductive transmission assembly includes a transmission coil, and a battery or a wired power supply applying electrical power to the transmission coil.

16 Claims, 3 Drawing Sheets

(51) Int. Cl.
*A63H 3/00* (2006.01)
*A63H 33/08* (2006.01)
*A63H 33/26* (2006.01)

(58) Field of Classification Search
USPC ..... 446/268, 391
See application file for complete search history.

(56) References Cited

U.S. PATENT DOCUMENTS 2,506,328 A * 5/1950 Alger ..... A63H 9/00 446/98
2,619,772 A * 12/1952 Dikszas ..... A63H 3/38 446/392
2,748,256 A * 5/1956 Moran ..... A63H 3/04 362/362
3,531,890 A * 10/1970 Citron ..... A63H 3/006 446/300
3,531,891 A * 10/1970 Goldfarb ..... A63H 13/04 446/303
4,205,482 A 6/1980 Christiansen
4,828,527 A * 5/1989 Spector ..... A63H 3/28 446/219
4,988,111 A * 1/1991 Gerlizt ..... A63F 9/0291 273/DIG. 17
5,730,638 A 3/1998 Ward
6,699,094 B1 3/2004 Ward
6,893,315 B2 * 5/2005 Barri ..... A63H 3/46 446/376
8,414,351 B2 * 4/2013 Garbos ..... A63H 33/22 362/554
9,061,216 B1 6/2015 Hooper et al.
2007/0060011 A1 * 3/2007 Daftari ..... A63H 3/46 446/97
2013/0217295 A1 8/2013 Karunaratne
2015/0283471 A1 10/2015 Bergemann
2016/0067626 A1 * 3/2016 Karunaratne ..... A63H 33/086 446/124

OTHER PUBLICATIONS brickarchitect.com, LEGO Figures in Scale Models, Alphin, T, available on Jul. 19, 2017, retrieved on Sep. 17, 2018, https://web.archive.org/web/20170719172923/, http://brickarchitect.com/scale.
PCT International Searching Authority; International Search Report and Written Opinion dated Nov. 15, 2018; entire document.

* cited by examiner

LIGHTED TOY FIGURINES AND RELATED SYSTEMS AND METHODS

CROSS-REFERENCE TO RELATED APPLICATION

This application claims the benefit of U.S. Provisional Application Ser. No. 62/540,671, filed on Aug. 3, 2017, the contents of which are herein incorporated by reference in their entirety.

FIELD OF THE INVENTION

The present invention relates to building toys, and more particularly, to interlocking building block sets including toy figurines.

BACKGROUND OF THE INVENTION

Interlocking building block sets are well known, and provide countless hours of enjoyment for children and adults. To add to the enjoyment of creating and playing with buildings, vehicles, etc. constructed from such sets, one or more figurines are often included. The figurines are sized so as to fit the scale of the creations, and allow users to populate and more fully interact therewith.

Generally, such figurines will have a body and head, with the head often being removable from the body and the body being articulable to some degree. For instance, the body will often include independently pivotable arms and legs, and may disconnect between upper and lower sections thereof. This affords greater design flexibility and the opportunity for selectively altering the appearance and equipment of figurines.

In some cases, accessories are provided for placement on the head, or between the head and upper body section. For example, a spaceman figurine might be provided with an air pack that is secured via loop between the head and upper body section and a helmet covering the head. Hats, detachable hair, floatation devices, and capes are just a few more examples of known accessories.

The addition of lighting is another means by which the visual interest and design possibilities of building sets can be enhanced. This is most typically done via the inclusion of one or more lighted blocks. The lighted blocks are typically internally powered by batteries or connected to powered block or other power source by a wire or other connection. Due to the small size of most toy figurines used with such building block sets, as well as the desire for the figurines to be readily movable throughout a constructed set for play, the typical power options are often not desirable for use in connection the lighting of toy figurines.

SUMMARY OF THE INVENTION

In view of the foregoing, it is an object of the present invention to provide improved lighted toy figurines and related toy building set systems and methods. It is a further object of the present invention to provide improved systems and methods for supplying power to toy building blocks within a playset.

According to an embodiment of the present invention, a lighted toy figurine comprises a figurine body assembly and a headgear assembly. The figurine body assembly includes a head and a body section. The headgear assembly includes a headpiece arranged on the head and a pack element extending downwardly therefrom along a side of the body section.

The pack element includes a power source and light powered thereby. The headpiece defines an internal channel communicating between at least one headpiece opening and the light such that illumination from the light is visible through the at least one headpiece opening via the internal channel.

According to another embodiment of the present invention, an inductive power transfer system for an interlocking building block set comprises a toy building block and an inductive transmission assembly. The toy building block includes an electrical load and a power source supplying the electrical load, the power source including an inductive receiver coil. The inductive transmission assembly includes a transmission coil, and at least one of a battery and a wired power supply applying electrical power to the transmission coil. According to an aspect of the present invention, the toy building block is the lighted toy figurine.

These and other objects, aspects and advantages of the present invention will be better appreciated in view of the drawings and following detailed description of preferred embodiments.

DETAILED DESCRIPTION OF PREFERRED EMBODIMENTS

Figure 2:
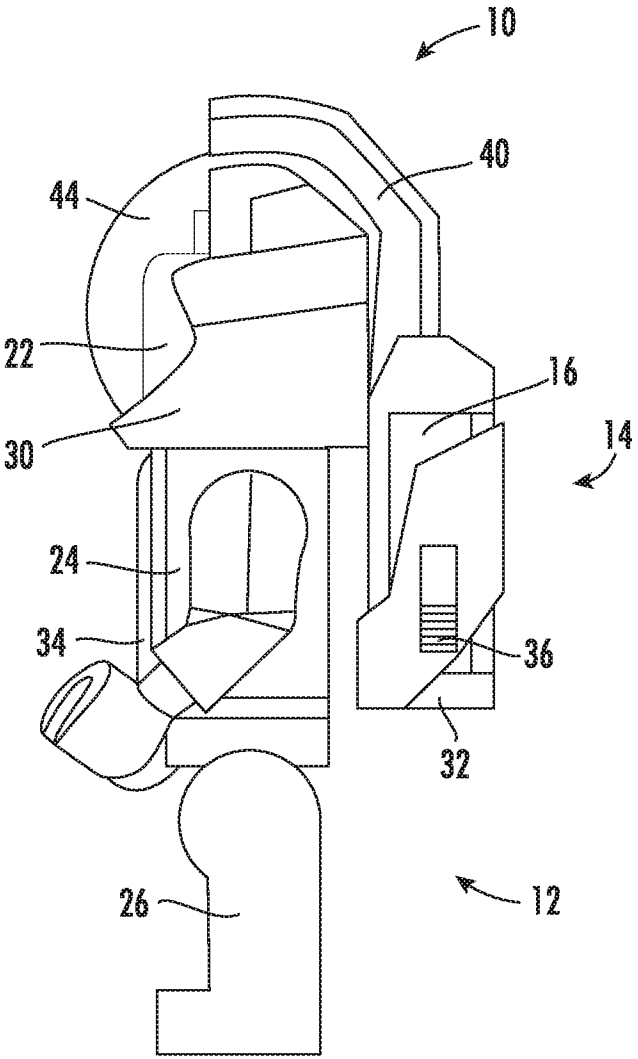
FIG. 2 is a side view of the lighted toy figurine of FIG. 1, with the headgear assembly rendered transparent to show internal details.
Figure 1:
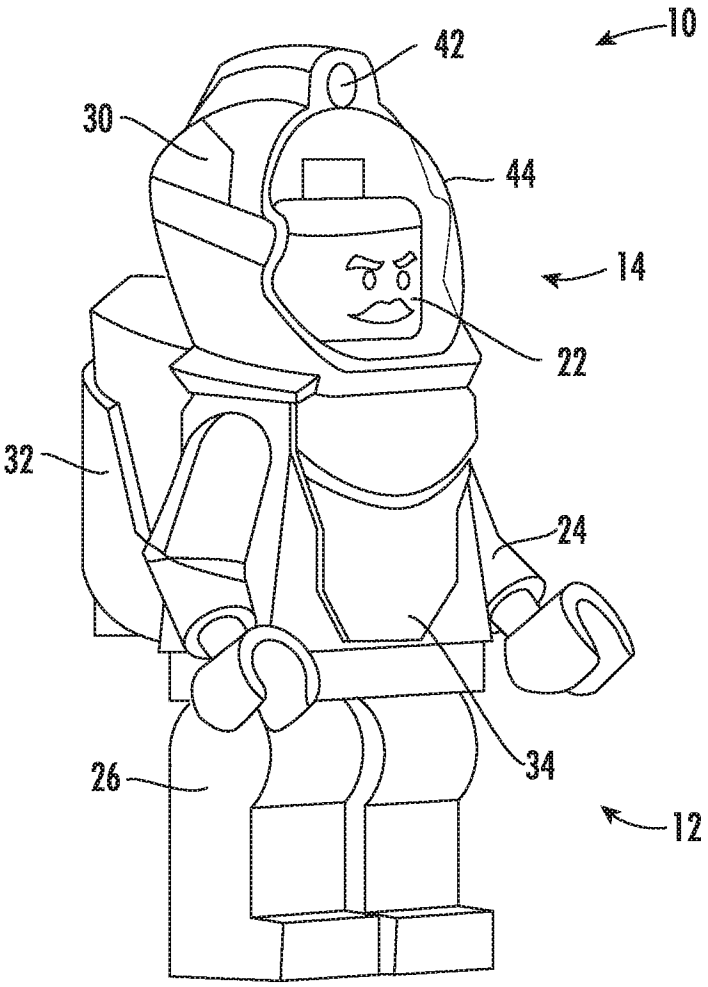
FIG. 1 is front perspective view of a lighted toy figurine including a headgear assembly, according to an embodiment of the present invention.
Figure 4:
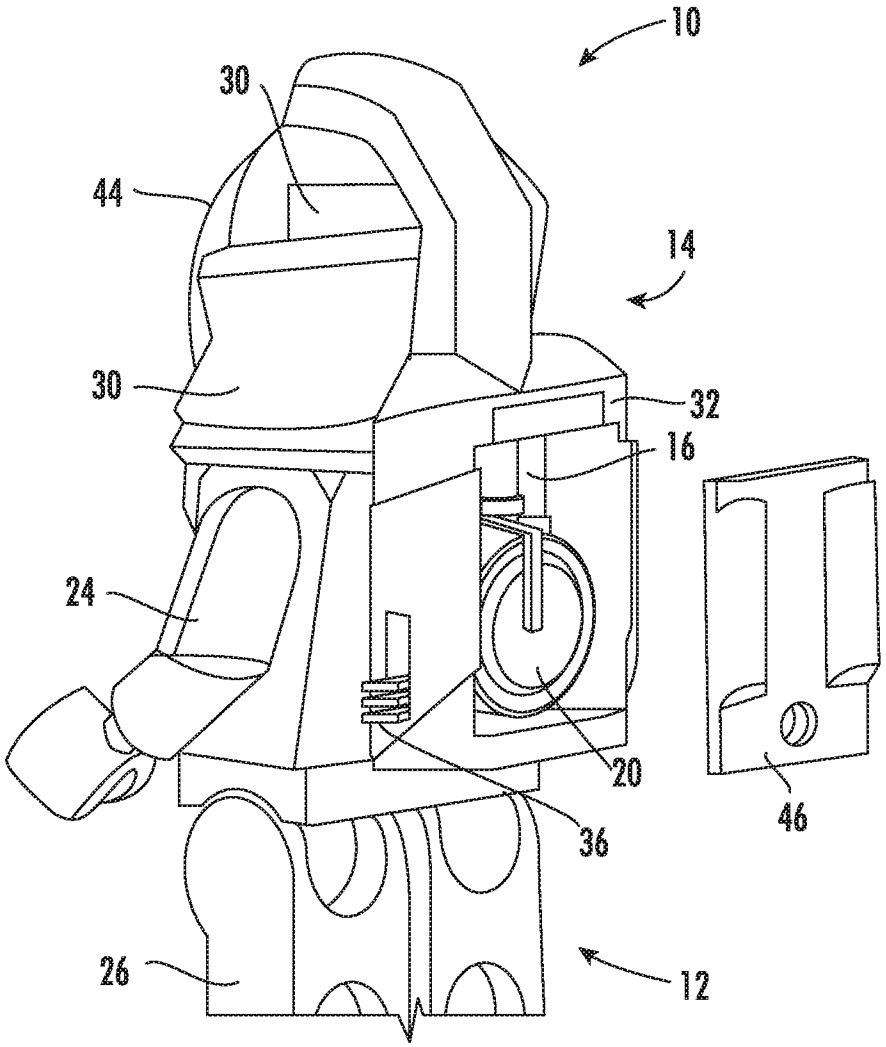
FIG. 4 is a partially exploded rear perspective view of the lighted toy figurine of FIG. 1.
Figure 3:
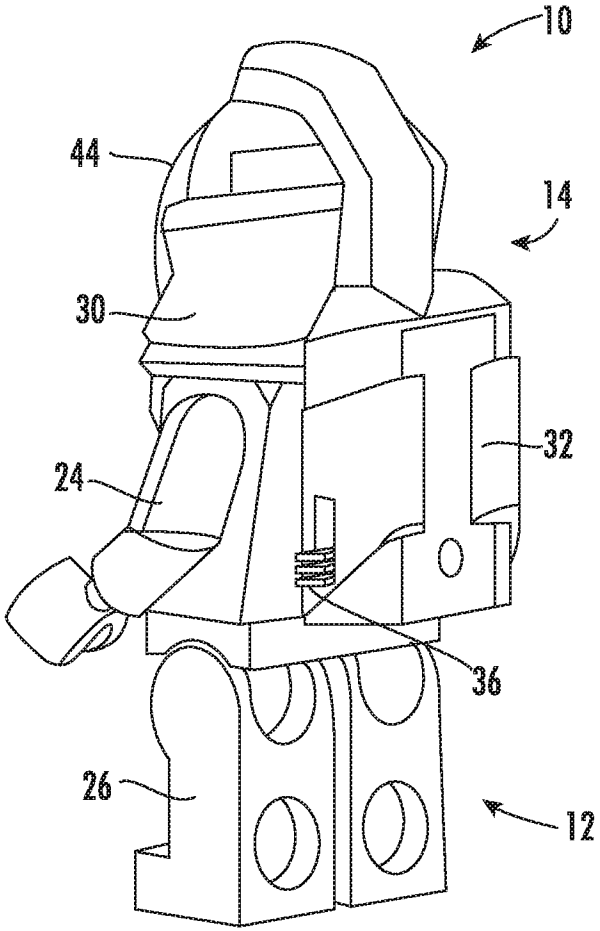
FIG. 3 is a rear perspective view of the lighted toy figurine of FIG. 1.

According to an embodiment of the present invention, referring to FIGS. 1-4, a lighted toy figurine 10 includes a figurine body assembly 12 on a which a lighted headgear assembly 14 is worn. The headgear assembly 14 includes at least one light 16 and power source 20 and is operable to supply illumination to the lighted toy figurine 10.

The body assembly 12 preferably includes a detachable head 22, upper body section 24 and lower body section 26. The upper section 24 advantageously includes pivotable arms, and the lower section 26 pivotable legs. It will be appreciated, however, that other body assembly 12 designs could be employed, including unitary assemblies and assemblies with more or less articulation. The body assembly 12, and more particularly the feet and hands of the body assembly 12, are configured to engage with other components of an interlocking building block set, such that the toy figurine 10 can be releasably secured thereto in various attitudes. An overall height of the body assembly is preferably less than two inches and more preferably approximately 1.5 inches. The relative proportions of the depicted body assembly are generally preferred, although other proportions could be used.

The headgear assembly 14 includes a headpiece 30, such as the depicted helmet, having a pack element 32 extending downwardly therefrom. An internal surface of the headpiece 30 preferably secures to a connection element on the top of the head 22 to releasably secure the headgear assembly 14 to the body assembly 12. The pack element 32 extends down a front or rear side of the upper body section 24, preferably so as not to interfere with pivoting of the arms and legs. The headgear assembly 14 can further include a decorative panel 34 extending downwardly from the headpiece 30 along the upper section 24 opposite the pack element 32.

The pack element 32 advantageously contains the light 16 and power source 20. The light 16 preferably includes one or more light-emitting diodes. In the depicted embodiment, the power source 20 is a battery and supply of power therefrom to the light 16 is controlled by a switch 36; however, it will be appreciated that other power and/or switching arrangements could be used. Additionally, multiple color lights 16 could be included with the switch 36 operable to select therebetween.

An internal channel 40 is formed within the headpiece 30 allowing illumination from the light 16 to be visible via one or more openings 42 formed at the top and/or front of the headpiece 30. The headpiece 30 can also be configured to allow the light 16 to illuminate inside the headpiece (e.g., inside the depicted helmet). To enhance such effect, the headpiece 30 can include a transparent or translucent face shield 44.

The pack element 32 includes a removable closure 46 allowing access to the power source 20 and/or light 16. The closure 46 can be held in place by a screw or other releasable fastening element.

In the depicted embodiment, the pack element 32 is releasably attached to the body assembly 12 by the headpiece 30. It will be appreciated that a pack element with light(s) and power source could be configured for attachment in other ways. For example, the pack element 32 (and optionally decorative panel 34) could be retained by a connecting portion extending across the upper section 24 and held in place by the head 22. Additionally, connection elements could be formed on a front or rear surface of the upper section 24 and the pack element 32 attached directly thereto.

While light-emitting diodes and batteries exist that could be fitted directly into a body assembly of the preferred dimensions, accomplishing this in practice would generally be expensive and sub-optimal with respect to use in a children's toy. Additionally, for most play scenarios, it is more realistic for accessories to the figurine to be lighted than the figurine, itself. The present invention allows lighting to be incorporated onto a figurine in a manner that uses more standard-sized and economical components and is more readily manufactured.

Figure 5:
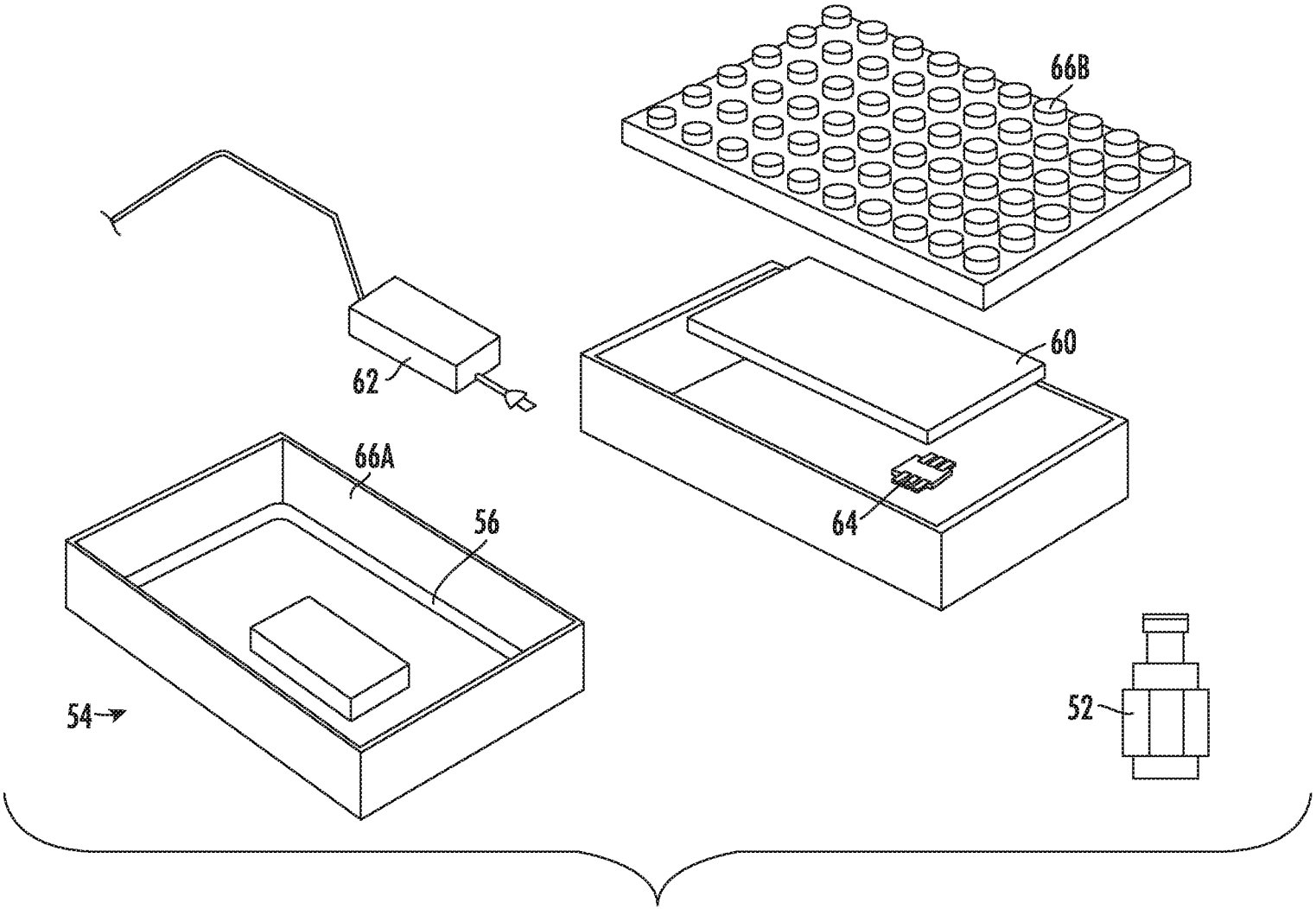
FIG. 5 is a partially exploded view of components of a wireless power transmission assembly for use in connection with the lighted toy figurine of FIG. 1 and other powered building blocks.

In the depicted embodiment, a battery is used as the power source 20. Alternatively, referring to FIG. 5, the figurine 10 could be configured for use in connection with an inductive power transfer system 50. When so configured, the battery of the power source 20 would be replaced (or supplemented) by an inductive receiver coil 52. The inductive receiver coil 52 receives power wirelessly from an inductive transmission assembly 54 including a transmission coil 56. The transmission coil 56 is powered from a battery 60 and/or wired power supply 62. A controller 64 controls application of electrical power to the transmission coil 56.

Preferably, the transmission assembly 54 is contained within a housing 66A, 66B that is configured to engage other elements of an interlocking building set. When in sufficient proximity to the transmission assembly 54, the receiver coil 52 will receive electrical power therefrom and illuminate the light of the headgear assembly 14.

The receiver coil 52 and power source 20 could be further configured with electronics to distinguish between different characteristics of the transmitted power. Likewise, the transmission assembly 54 can be configured to vary characteristics of transmitted power and/or different transmission assemblies could be used. Consequently, the color of light emitted, flashing effects, etc. could be varied based on the characteristics of the transmitted power without a need for additional, externally-accessible controls on the figurine 10.

The foregoing description of preferred embodiments is provided for illustrative and exemplary purposes; the present invention is not necessarily limited thereto. Rather, those skilled in the art will appreciate that various modifications, as well as adaptations for particular circumstances, will fall within the scope of the invention as herein shown and described and of the claimed appended hereto.

What is claimed is:

1. A lighted toy figurine comprising:
- a figurine body assembly including a head and a body section;
- a headpiece with an interior for receiving said head therein, wherein said headpiece is selective attachable to and detachable from said head, and wherein said headpiece has at least one opening for viewing said interior of said headpiece;
- a pack element extending from said headpiece, wherein said pack element extends downwardly along said body section when said headpiece is attached to said head;
- a power source contained within said pack element, and a light contained within said pack element that is powered by said power source;
- an internal channel communicating between said at least one opening and said light such that said light illuminates said at least one opening via said internal channel.

2. The lighted toy figurine of claim 1, wherein said head is detachable from said body section.

3. The lighted toy figurine of claim 1, wherein said body section includes an upper body section and a lower body section, said head being attached to said upper body section and said lower body section including legs.

4. The lighted toy figurine of claim 3, wherein said upper body section and said lower body section are detachable.

5. The lighted toy figurine of claim 3, wherein said upper body section includes arms.

6. The lighted toy figurine of claim 5, wherein said arms and said legs are pivotable.

7. The lighted toy figurine of claim 1, further including a connection element on said head for attaching said head to said headpiece.

8. The lighted toy figurine of claim 1, wherein said headpiece is a helmet.

9. The lighted toy figurine of claim 8, wherein said at least one opening is positioned such that said light illuminates said interior of said helmet.

10. The lighted toy figurine of claim 9, wherein said helmet includes a transparent or translucent face shield.

11. The lighted toy figurine of claim 1, further including a panel that extends downwardly from said headpiece along said body section pack element.

12. The lighted toy figurine of claim 1, wherein said light includes at least one light-emitting diode.

13. The lighted toy figurine of claim 1, wherein said power source includes at least one battery.

14. The lighted toy figurine of claim 13, wherein said pack element further includes a switch operable to control a supply of power from said battery to said light.

15. The lighted toy figurine of claim 1, wherein said pack element includes a removable closure allowing access to at least one of said power source and said light.

16. The lighted toy figurine of claim 1, wherein said power source includes an inductive receiver coil configured to receive power wirelessly from an inductive transmission assembly.

* * * * *